US006252521B1

(12) United States Patent
Griffin et al.

(10) Patent No.: US 6,252,521 B1
(45) Date of Patent: Jun. 26, 2001

(54) EMERGENCY VEHICLE ALERT SYSTEM

(76) Inventors: Willie J. Griffin; Anita F. Griffin, both of 2327 22nd St., S., St. Petersburg, FL (US) 33712

( * ) Notice: Subject to any disclaimer, the term of this patent is extended or adjusted under 35 U.S.C. 154(b) by 0 days.

(21) Appl. No.: 09/710,636

(22) Filed: Nov. 8, 2000

(51) Int. Cl.[7] ..... G08G 1/16

(52) U.S. Cl. ..... 340/903; 340/904; 340/902; 340/435; 340/384.1; 340/815.45

(58) Field of Search ..... 340/902, 903, 340/904, 435, 436, 384.1, 815.45; 701/301

(56) References Cited

U.S. PATENT DOCUMENTS 5,307,060 * 4/1994 Prevulsky et al. ..... 340/902
5,572,201 * 11/1996 Graham et al. ..... 340/902
5,808,560 * 9/1998 Mulanax ..... 340/902
5,825,304 10/1998 Marin ..... 340/903
5,889,475 3/1999 Klosinski et al. ..... 340/902
5,894,279 * 4/1999 Rose et al. ..... 340/902
5,926,112 7/1999 Hartzell ..... 340/902
5,933,093 8/1999 Austin, II ..... 340/902
5,959,551 9/1999 Cardille ..... 340/902

* cited by examiner

*Primary Examiner*—Daniel J. Wu
(74) *Attorney, Agent, or Firm*—Joseph N. Breaux

(57) ABSTRACT

An emergency vehicle alert system that includes transmitter units mountable within emergency vehicles and receiver units mountable within civilian vehicles. The transmitter units and the receiver units via a mechanism within each receiver unit that provides each civilian driver with an indicator of the distance between his/her civilian vehicle and the emergency vehicle.

2 Claims, 2 Drawing Sheets

EMERGENCY VEHICLE ALERT SYSTEM

TECHNICAL FIELD

The present invention relates to vehicle safety equipment and more particularly to an emergency vehicle alert system that provides a mechanism for alerting civilian drivers of the approach of an emergency vehicle such as an ambulance, police car, fire truck, or the like; the emergency vehicle alert system includes a number of emergency vehicle constant signal strength transmitter units for installation in emergency response vehicles and a number of signal receiving units for installation in civilian vehicles; each of the emergency vehicle constant signal strength transmitter units including a radio transmitter having an activation switch for allowing an operator to activate the radio transmitter when responding to an emergency, each of the radio transmitters transmitting an emergency vehicle approaching radio signal at a predetermined, set radio frequency, in all directions and at a constant signal strength that is equal to the signal strength of the emergency vehicle approaching radio signal transmitted by the radio transmitter of every other emergency vehicle constant signal strength transmitter unit and at the same predetermined radio frequency; each of the signal receiving units including a radio receiver circuit tuned to the predetermined set radio frequency of the emergency vehicle constant signal strength transmitter units and a signal strength detecting circuit having a signal strength detector input in connection with a receiver output of the radio receiver circuit, a variable speaker power output in connection with the variable output speaker and a variable LED power output in connection with the variable output LED light system; the signal strength detector circuit supplying power to the variable speaker power output and the variable LED power output at levels directly proportional to the strength of the received emergency vehicle approaching radio signal such that, as the distance between the transmitter unit and the receiver unit decreases, power to the variable speaker power output and the variable LED power output increases and as the distance between the transmitter unit and the receiver unit increases, power to the variable speaker power output and the variable LED power output decreases, thereby, allowing a driver of a civilian vehicle to gauge the distance between an emergency vehicle and the civilian vehicle; the signal receiving units including only on/off control knobs for the variable output speaker and the variable output LED light system.

BACKGROUND ART

Accidents can occur when a civilian vehicle driver is suddenly confronted with a rapidly traveling emergency vehicle and the associated blaring sirens and the confusion of the other civilian drivers. It would be a benefit for everyone concerned to have an emergency vehicle alert system that included a transmitter unit carried in each emergency vehicle and a receiver unit carried in each civilian vehicle wherein the transmitter units communicated to the receiver units information regarding the approach of an emergency vehicle before the sound of a siren could be heard as well as constantly updated information regarding the distance between the emergency vehicle and each of the civilian vehicles. Because it would be difficult for the emergency vehicle to transmit a signal communicating a separate distance to each and every receiver unit, it would be a benefit if the emergency vehicle alert system included transmitter units and receiver units having mechanisms for each receiver unit to determine the distance between itself and the emergency transmitter unit.

GENERAL SUMMARY DISCUSSION OF INVENTION

It is thus an object of the invention to provide an emergency vehicle alert system that includes a number of emergency vehicle constant signal strength transmitter units for installation in emergency response vehicles and a number of signal receiving units for installation in civilian vehicles; each of the emergency vehicle constant signal strength transmitter units including a radio transmitter having an activation switch for allowing an operator to activate the radio transmitter when responding to an emergency, each of the radio transmitters transmitting an emergency vehicle approaching radio signal at a predetermined, set radio frequency, in all directions and at a constant signal strength that is equal to the signal strength of the emergency vehicle approaching radio signal transmitted by the radio transmitter of every other emergency vehicle constant signal strength transmitter unit and at the same predetermined radio frequency; each of the signal receiving units including a radio receiver circuit tuned to the predetermined set radio frequency of the emergency vehicle constant signal strength transmitter units and a signal strength detecting circuit having a signal strength detector input in connection with a receiver output of the radio receiver circuit, a variable speaker power output in connection with the variable output speaker and a variable LED power output in connection with the variable output LED light system; the signal strength detector circuit supplying power to the variable speaker power output and the variable LED power output at levels directly proportional to the strength of the received emergency vehicle approaching radio signal such that, as the distance between the transmitter unit and the receiver unit decreases, power to the variable speaker power output and the variable LED power output increases and as the distance between the transmitter unit and the receiver unit increases, power to the variable speaker power output and the variable LED power output decreases, thereby, allowing a driver of a civilian vehicle to gauge the distance between an emergency vehicle and the civilian vehicle; the signal receiving units including only on/off control knobs for the variable output speaker and the variable output LED light system.

Accordingly, an emergency vehicle alert system is provided. The emergency vehicle alert system includes a number of emergency vehicle constant signal strength transmitter units for installation in emergency response vehicles and a number of signal receiving units for installation in civilian vehicles; each of the emergency vehicle constant signal strength transmitter units including a radio transmitter having an activation switch for allowing an operator to activate the radio transmitter when responding to an emergency, each of the radio transmitters transmitting an emergency vehicle approaching radio signal at a predetermined, set radio frequency, in all directions and at a constant signal strength that is equal to the signal strength of the emergency vehicle approaching radio signal transmitted by the radio transmitter of every other emergency vehicle constant signal strength transmitter unit and at the same predetermined radio frequency; each of the signal receiving units including a radio receiver circuit tuned to the predetermined set radio frequency of the emergency vehicle constant signal strength transmitter units and a signal strength detecting circuit having a signal strength detector input in connection with a receiver output of the radio receiver circuit, a variable speaker power output in connection with the variable output speaker and a variable LED power output in connection with the variable output LED light system; the signal strength detector circuit supplying power to the variable speaker power output and the variable LED power output at levels directly proportional to the strength of the received emergency vehicle approaching radio signal such that, as the distance between the transmitter unit and the receiver unit decreases, power to the variable speaker power output and the variable LED power output increases and as the distance between the transmitter unit and the receiver unit increases, power to the variable speaker power output and the variable LED power output decreases, thereby, allowing a driver of a civilian vehicle to gauge the distance between an emergency vehicle and the civilian vehicle. In a preferred embodiment, the receiver unit also includes on/off control knobs for the variable output speaker and the variable output LED light system.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
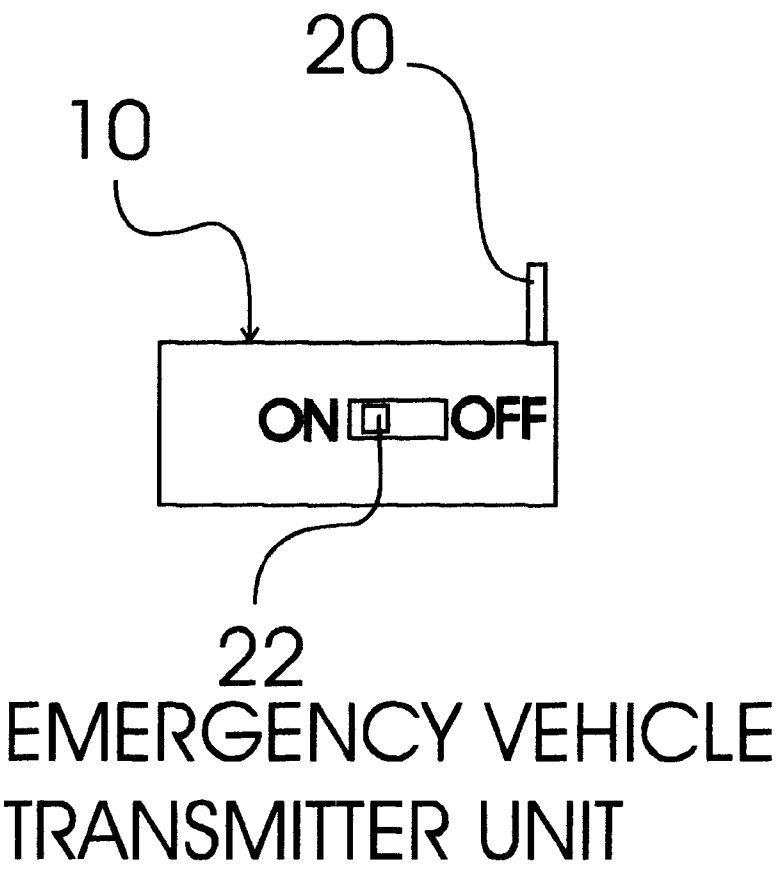
FIG. 1 is a front plan view of an exemplary embodiment of the emergency vehicle constant signal strength transmitter unit of the emergency vehicle alert system of the present invention.
Figure 2:
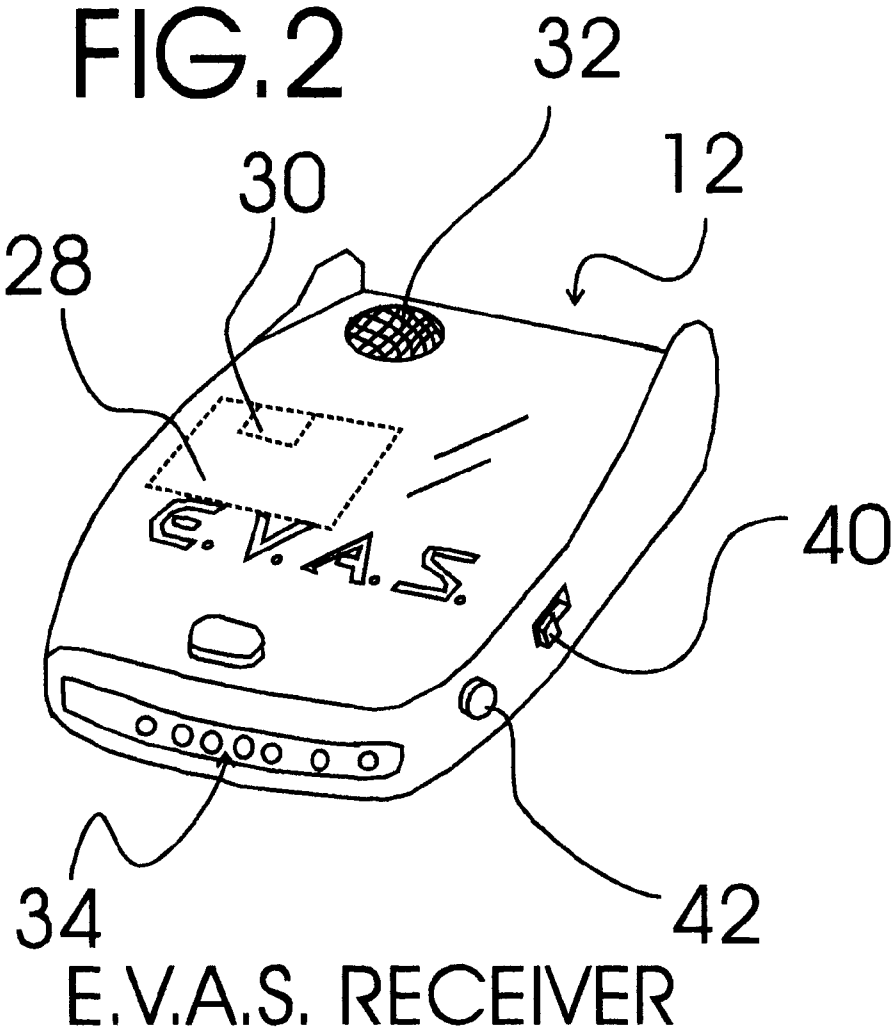
FIG. 2 is a perspective view of an exemplary embodiment of the signal receiving unit of the emergency vehicle alert system of the present invention showing the variable output speaker and LED light systems.
Figure 4:
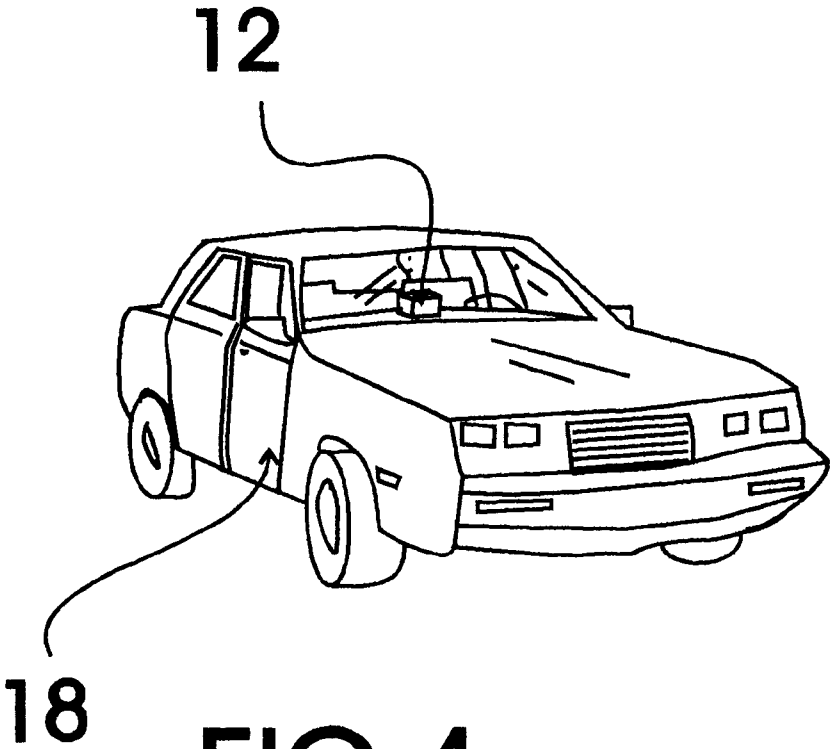
FIG. 4 is a perspective view of a representative civilian vehicle with the exemplary signal receiver unit of FIG. 2 installed therein.
Figure 3:
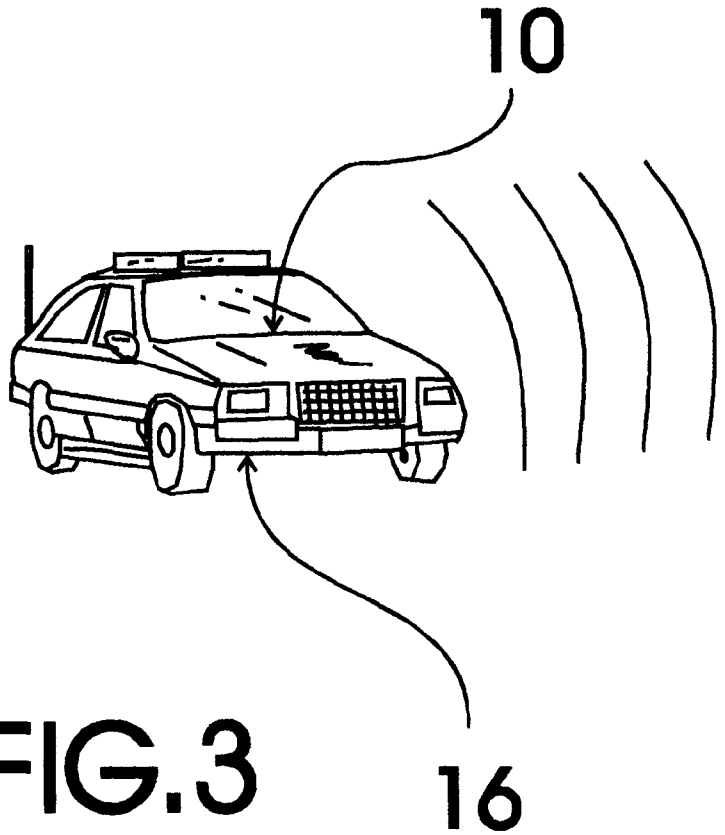
FIG. 3 is a perspective view of a representative police emergency vehicle with the exemplary emergency vehicle constant signal strength transmitter unit of FIG. 1 installed therein.

FIGS. 1–4 show various aspects of an exemplary embodiment of the emergency vehicle alert system of the present invention. The emergency vehicle alert system includes a number of emergency vehicle constant signal strength transmitter units, generally designated 10, for installation in emergency response vehicles, generally designated 16 and a number of signal receiving units, generally designated 12, for installation in civilian vehicles, generally designated 18.

Each of the emergency vehicle constant signal strength transmitter units 10 includes a radio transmitter circuit 20 having an activation switch 22 for allowing an operator to activate the radio transmitter circuit 20 when responding to an emergency. Each of the radio transmitter circuits 20 transmits an emergency vehicle approaching radio signal in all directions at a constant signal strength equal to the signal strength of the emergency vehicle approaching radio signal of the radio transmitter circuit 20 of every other emergency vehicle constant signal strength transmitter unit 10 and at the same predetermined radio frequency as every other emergency vehicle constant signal strength transmitter unit 10. Each of the signal receiving units 12 includes a radio receiver circuit 28 tuned to the predetermined radio frequency of the emergency vehicle constant signal strength transmitter units 10 and a signal strength detecting circuit 30 having a signal strength detector input in connection with a receiver output of the radio receiver circuit 28, a variable speaker power output in connection with the variable output speaker 32 and a variable LED power output in connection with the variable output LED light system 34. In this embodiment, receiver unit 12 includes a light on/off control knob for the variable output LED light system 34 and a mute switch 42 for silencing the speaker 32.

It can be seen from the preceding description that an emergency vehicle alert system has been provided.

It is noted that the embodiment of the emergency vehicle alert system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An emergency vehicle alert system for use with a number of emergency response vehicles and a number of civilian vehicles, said emergency vehicle alert system comprising:

a number of emergency vehicle constant signal strength transmitter units, each installable in one of the number of emergency response vehicles; and a number of signal receiving units, each installable in one of the number of civilian vehicles;

each of the emergency vehicle constant signal strength transmitter units including a radio transmitter having an activation switch for allowing an operator to activate the radio transmitter when responding to an emergency;

each of the radio transmitters transmitting an emergency vehicle approaching radio signal at a predetermined set radio frequency, in all directions and at a constant signal strength equal to the signal strength of the emergency vehicle approaching radio signal transmitted by said radio transmitter of every other said emergency vehicle constant signal strength transmitter unit and at the same predetermined set radio frequency;

each of said signal receiving units including a radio receiver circuit tuned to the predetermined set radio frequency of the emergency vehicle constant signal strength transmitter units and a signal strength detecting circuit having a signal strength detector input in connection with a receiver output of the radio receiver circuit, a variable speaker power output in connection with the variable output speaker and a variable LED power output in connection with the variable output LED light system;

the signal strength detector circuit supplying power to the variable speaker power output and the variable LED power output at levels directly proportional to the strength of the received emergency vehicle approaching radio signal such that, as the distance between the transmitter unit and the receiver unit decreases, power to the variable speaker power output and the variable LED power output increases causing the variable speaker output to become louder and more LED's to illuminate and as the distance between the transmitter unit and the receiver unit increases, power to the variable speaker power output and the variable LED power output decreases causing the variable speaker output to lessen in volume and fewer LED's to illuminate, thereby, providing dual mechanisms for allowing a driver of a civilian vehicle to gauge the distance between an emergency vehicle and a civilian vehicle driven by the driver.

2. The emergency vehicle alert system of claim 1 wherein:

the receiver unit includes an on/off control knob for the variable output LED light system and a mute button for silencing the variable output speaker.

* * * * *